United States Patent [19]

Fuhrboter et al.

[11] 4,052,800

[45] Oct. 11, 1977

[54] SYSTEM FOR GATHERING SOLIDS FROM THE OCEAN FLOOR AND BRINGING THEM TO THE SURFACE

[75] Inventors: Alfred Fuhrboter; Manfred Mittelstadt, both of Braunschweig, Germany

[73] Assignee: Salzgitter AG, Germany

[21] Appl. No.: 600,853

[22] Filed: July 31, 1975

[30] Foreign Application Priority Data

Aug. 1, 1974 Germany ..... 2437071

[51] Int. Cl.[2] ..... E02F 3/88

[52] U.S. Cl. ..... 37/58; 37/55; 37/195; 37/DIG. 8; 43/9; 172/612

[58] Field of Search ..... 37/DIG. 8, 57, 55, 58, 37/71, 195, 54; 214/10; 56/192; 299/9, 8; 43/9; 172/612

[56] References Cited

U.S. PATENT DOCUMENTS

| | | | |
|---|---|---|---|
| 1,480,192 | 1/1924 | Worsfold | 43/9 UX |
| 2,684,549 | 7/1954 | Olden | 43/9 |
| 2,686,380 | 8/1954 | Seppala | 43/9 |
| 2,747,354 | 5/1956 | Bloser | 56/192 UX |
| 3,015,903 | 1/1962 | Willingham | 43/9 |
| 3,126,865 | 3/1964 | Wiegardt, Jr. | 172/612 X |
| 3,248,812 | 5/1966 | Gardner, Jr. | 37/55 X |
| 3,305,950 | 2/1967 | Hirshman et al. | 37/58 |
| 3,310,894 | 3/1967 | Ball | 37/57 X |
| 3,433,531 | 3/1969 | Koot et al. | 299/8 |
| 3,438,142 | 4/1969 | Krutein | 37/195 |
| 3,456,371 | 7/1969 | Graham et al. | 37/195 |
| 3,480,326 | 11/1969 | Sheary et al. | 299/8 |
| 3,606,954 | 9/1971 | Mayer | 214/10 |
| 3,675,348 | 7/1972 | Dane, Jr. | 37/69 |

OTHER PUBLICATIONS

Clauss, G.; Maritime Rohstoffgewinnung, "Some Investigations into Airlift Systems for Mineral Recovery in Ocean Mining", pp. 315–322.

Hering, Von Norbert; Stahl U. Eisen 91 (1971), No. 8, 15 Apr.; "Metalle aus Tiefsee-Erzen"; pp. 452–459.

Page 28 of "World Fishing," Aug. 1967.

"New Dutch Beam Trawl Stops Flatfish Slaughter," pp. 96 & 99 of World Fishing, June, 1965.

"New Concept for Lifting Nodules," pp. 37–39 of Ocean Industry Digest, June, 1967.

*Primary Examiner*—Clifford D. Crowder

*Attorney, Agent, or Firm*—Brumbaugh, Graves, Donohue & Raymond

[57] ABSTRACT

A system for gathering solids disposed on the ocean floor by dragging a collecting apparatus along the ocean floor so as to deposit the solids in an extended pile, the collecting apparatus having a relatively large inlet opening and a relatively small exit opening. The solids are brought to the surface by conveying apparatus that draws the solids from the pile and drives them up to the surface, the conveying apparatus being independent of the collecting apparatus.

9 Claims, 5 Drawing Figures

SYSTEM FOR GATHERING SOLIDS FROM THE OCEAN FLOOR AND BRINGING THEM TO THE SURFACE

BACKGROUND OF THE INVENTION

It is known that valuable mineral deposits lie on the bottom of the ocean. Since nodules rich in manganese, for example, lie scattered on the ocean floor with a relatively low density, their direct collection without preparatory measures would not be economical. They are therefore first collected and then hauled to the surface. In the past, these two steps of the method, and also the type of equipment used in carrying out these steps, have always had one common feature, namely that the nodule collecting process on the sea bottom is directly coupled with the hauling process.

It is known from the trade journal "Ocean Industry," June, 1967, No. 6, at pages 37 to 39, to recover manganese nodules by means of two submerged units, whereby a ship tows a receptacle on the bottom of the sea which collects the nodules by sweeping the ocean bottom over a defined width, and a hauling unit disposed above the collecting receptacle and connected thereto. The nodules are collected in the receptacle, and are from there hauled upwardly by means of suction and by way of a hauling conduit connected between the end of the collecting receptacle and the hauling unit. Both steps of the method, namely collection and conveying upwardly, already pose considerable problems. In addition, the maximum possible rate of advance of the entire equipment does not permit a favorable adjustment between the two process steps, or only at an expenditure of such proportions that its success is questionable. There exists substantial uncertainty as to whether the economical object can be attained, namely to achieve a certain massive flow of the nodules on their upward path.

The production objective, the width of collection on the ocean floor and the rate of advance are related by the equation:

$$Q_F = V \times b \times q,$$

wherein $Q_F$ is the production objective (upward flow of solids or flow of mass collected) in kg/sec.;

$v$ is the rate of advance of the collecting device in m/sec.;

$b$ is the collecting width in m;

$q$ is the average nodule density on the ocean floor in kg/m².

Assuming that the rate of collection amounts to 100% and that the amount of ore collected is also conveyed, the production objective at a given average nodule density can be influenced only through the speed "$v$" of the collecting device and the collecting width "$b$". More exact deliberations would have to be based on the fact that these rates can be achieved only asymptotically; however, this does not affect the basis of the present considerations.

The existing problems are brought to light by the following numerical example.

Although the economical production objectives fluctuate over broad ranges, one can reckon with an average production objective of 300 tons/hour, because this value corresponds approximately with the average production rate of a land-based ore mine.

With an assumed rate of advance of the collecting and conveying equipment of 0.5 m/sec. and an average nodule density of $q = 10$ kg/m² (according to the latest exploration results) a collecting width of $b = 16.6$ m is required for the collecting device. If the possible rate of collection is reduced to 50%, the required collecting width would be double the above amount, namely 33 meters. In order to keep the required collecting width smaller, the above equation would require an increase of the rate of advance of the entire equipment; however, a rate of advance of 0.5 m/sec. is already decidedly too high.

The stationary hydrodynamic forces acting on the underwater equipment increase with the square of speed, or advancement; the additional problem posed by the hydroelastic vibrations need be merely mentioned here. The rate of advance has a particularly unfavorable effect on the hauling conduit, because the pipe segments must be equipped with buoyant bodies for compensating for the natural weight of the pipe segments. These buoyant bodies cause a substantial increase in flow resistance. This applies also to possible underwater stations provided within the pipeline assembly for the purpose of ore separation and for accommodating navigational and control equipment. It is impossible to determine exactly the additional resistive forces originating from the collecting equipment connected with the pipeline assembly as a result of an increased rate of advance, and the vibrational behavior of the pipeline.

Because of the afore-mentioned unfavorable influences, the speed of the entire underwater equipment should thus be kept in the order of magnitude of from 0.1 to 0.2 m/sec. However, with a collecting rate of 100%, this would entail collecting widths of from 45 to 90 meters.

This numerical example based on practical experience shows that the collection process should be carried out at a relatively high speed so that the collecting device may be kept within justifiable limits in terms of its dimensions, which is important for safe functioning of the device. On the other hand, the hauling of the nodules upwardly requires a relatively low rate of advance in view of the hydrostatic and hydrodynamic resistances. This relatively low rate of advance is economical only if the nodules are present in sufficient quantities. Therefore, the problem of nodule recovery lies in making such sufficient quantities available and in harmonizing such quantities with the rate of advance of the hauling equipment.

SUMMARY OF THE INVENTION

Accordingly, the present invention has for an object the provision of measures by which the hauling of solids of the afore-mentioned type from the bottom of the sea to the surface may be facilitated by providing collection sites whose surface areas have been reduced from the natural size for such solids, namely by increasing the density of the solids.

It is a further object of the invention to provide a collecting apparatus that effects a concentration of the solids on the sea bottom, thereby providing the conditions required for attaining the production objective. This apparatus provides great safety against getting stuck or tilting over, while it loads the sea bottom only lightly. Moreover, it separates the sedimentation on the ocean floor from the solids to be collected.

The collecting apparatus according to the invention includes a net having a relatively large inlet opening and a relatively small exit opening, the net assuming a flattened conical shape when dragged.

Nets that are conically shaped when in the towed condition are known already in the field of tuna fishing; however, such nets serve another purpose, namely catching fish. Moreover, such known fishing nets do not exhibit the additional characteristics provided by the present invention.

The principal advantage of the collecting apparatus is that it permits a densifying or concentrating of solids, for example, manganese nodules, deposited within a mining area, and thereby satisfies the prerequisites for an economical mining of these solids. By virtue of the design of the net, which automatically effects a rough separation of the sea bottom sedimentation from the manganese nodules while being dragged, the device is of such a light weight that the lower limit of the sea bottom's load capacity need not to be taken into consideration. The flat conical shape of the net insures great stability against tilting. It is safeguarded against stalling (getting stuck) simply on account of the fact that the cable or cables pulling the net extend upwardly to the surface in a sagging manner when the apparatus is dragged due to the great ocean depth, but the cables are tensioned when the apparatus is temporarily halted, whereby their angle of ascent relative to the apparatus is increased. The upwardly directed component of the dragging force is thus increased and assists the apparatus in overcoming the obstacle.

An additional feature of the densifying apparatus is its very simple design; the number of moving parts is very limited, and it does not include any rotary parts or electrical components, which enhances its insensitivity. Operational breakdowns as a result of corrosion may be disregarded because the apparatus does not include any precision fittings or any precision-made parts. Its manufacturing costs are low, so that only minimum losses are incurred if the apparatus should be lost, so that expensive recovery operations may be omitted.

An "apron" consisting of a heavy chain net, preferably made of an iron-containing material, is suitably supported by its leading edge ahead of the inlet opening of the collecting net, so that it extends across the width of the inlet opening and rests at least partially on the bottom of the sea. The apron forms suitably at least a portion of the bottom of the collecting net. This apron, because of its weight, penetrates somewhat into the sea bed and loosens the bed, so that the net is subsequently capable of seizing also those manganese nodules which are disposed somewhat deeper in the bed, or which adhere with greater strength to the bed. For the purpose of increasing the effectiveness of the apron, the mesh size of the apron is advantageously reduced toward its rear end.

A further feature of the present invention is that the collecting net, at the inlet opening, is connected on either side to the trailing end of a skid plate disposed substantially vertically and diverging outwardly ahead of the net. The skid plates are connected to each other by means of a chain of buoyant bodies. At least one additional skid plate is disposed ahead of each of said skid plates by means of the pulling cables, the additional skid plates being also disposed in a diverging, substantially vertical position, with the mean spacing between the additional skid plates being larger than the spacing between the first mentioned skid plates.

It is one of the advantages of this design that the skid plates not only hydrodynamically force the inlet opening of the net, but also increase the performance, since they feed nodules to the net from areas which are disposed adjacent to the net and would otherwise not be covered. This effect is increased even more by the additional skid plates. The chain of buoyant bodies, on which advantageously the apron may be suspended, determines the inclined or divergent position of the skid plates, which angular position may vary depending upon the dragging speed and the conditions prevailing on the sea bottom.

It may in some cases be necessary to predetermine the inlet opening of the collecting net. In such cases it is advantageous to provide a rigid frame having a flat, U-shaped ends on which the net is appended, the rounded portion of the end extending forwardly of the net. Alternatively, the frame may be in the form of a V-shaped yoke having ends extending generally perpendicular to the plane of the V-shaped portion, the net being appended to the ends and a chain of buoyant bodies being connected between the ends. With these embodiments, it is of course also possible to provide diverging skid plates, in such cases rigidly connected to the frame or yoke, and also to provide additional skid plates.

It is a further object of the present invention to provide a method permitting a relatively high rate of advance when collecting the nodules, and a relatively low rate of advance for the equipment conveying the nodules upwardly to the surface. Such a method comprises a continuous collection of the solids over wide strips and depositing of the solids again on the ocean floor in corresponding extended piles, with the width of such piles being many times less than the width of the strips, after which these extended piles of solids are removed in a separate process step that is independent from the step of pile-forming.

The advantages of the method are in the timewise and spacewise separation of the collecting step from the hauling step. One ship takes over the task of collecting or concentrating the solids, while another ship is given the task of removing the piles from the ocean floor and hauling the nodules upward to the surface.

This timewise independence of the collecting step from the hauling step offers important advantages as regards the availability of ship capacities because ship capacities may be utilized for the collecting or pile-forming step as they become available in accordance with the market situation, requiring only simple on-board modifications. Also, ships may be employed which were retired from active service. This timewise independence furthermore permits the collecting or concentrating step to be carried out during bad weather periods which would interrupt the delicate hauling process.

The collecting and concentrating step may be carried out at relatively high rates, gathering the manganese nodules strewn over wide areas with only sparse nodule density, and concentrating said nodules in a small area with high nodule density, by forming piles of nodules.

The hauling ship, for example a semi-submerged watercraft or a floating platform, which carries out the pile removal and upward hauling step hours, days or weeks after the collection step, may move at a low speed while hauling the piled-up ore to the ocean surface. The hydrodynamic stresses acting on the hauling line are thereby small. Under these conditions, providing the hauling pipe assembly with buoyant bodies (for counteracting the natural weight of the pipes) does not pose any problems, because the low rate of advance will keep the flow resistance low even with an enlarged area of resistance. Likewise, the installation of underwater stations for accommodating pumps, control devices and equipment for observing the ocean floor is simplified. If semi-submerged watercraft are used, the working conditions, for example, aboard the vessel may be improved, or hauling methods may be employed which are specifically designed for such semisubmerged facilities.

In order to achieve a complete recovery of the piles of manganese nodules, their recovery is suitably kept on course by means of control and steering equipment dependent upon the course of the piles. The recovery of each strip pile is advantageously carried out continuously in one operation.

BRIEF DESCRIPTION OF THE DRAWINGS

The present invention is explained in greater detail with the help of the exemplary embodiments shown in the figures of the accompanying drawings, in which.

DESCRIPTION OF EMBODIMENTS

Figure 1:
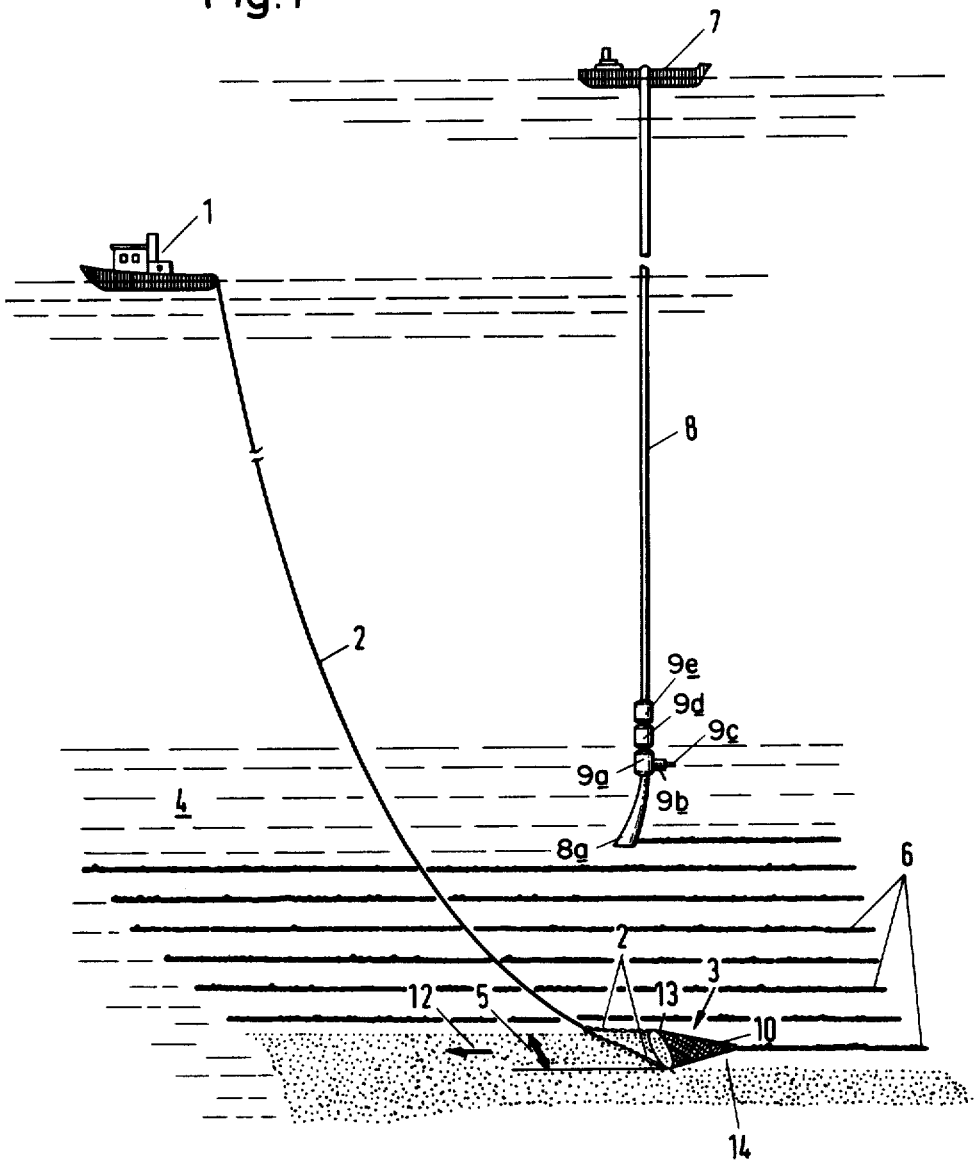
FIG. 1 is a perspective view of apparatus for recovering nodules from the ocean floor with the help of two vessels working independently from each other in accordance with the invention.

In FIG. 1, 1 designates a ship which by means of cables 2 drags on the ocean floor 4 an apparatus 3 for collecting and concentrating manganese nodules deposited on the ocean floor with a relatively low density. The apparatus 3 collects wide strips 5 of the manganese nodules and deposits these nodules again in a concentrated form on the ocean bottom 4, namely in the form of extended piles 6. These piles 6 are removed with the help of a hauling ship 7, which is operated independently from, and at a lower speed than, the ship 1. The hauling ship 7 is provided with a hauling pipe 8 extending downward to one of the piles 6, with underpressure being produced within the pipe 8 so that the manganese nodules are carried along upwardly by the flow of water.

The collection of the piles 6 is carried out continuously and completely, because the intake orifice 8*a* at the lower end of the pipe 8 is guided along the piles 6 by means of steering and control apparatus located in adjacent overlying relation to the intake orifice 8*a*. In particular, a housing 9*a* mounts a conventional underwater television camera 9*b* and one or more lamps 9*c* for observing the ocean floor ahead of the intake orifice 8*a*.

A housing 9*d* mounts apparatus for controllably adjusting the position of the intake orifice 8*a* with respect to the ocean floor 4. Such control apparatus includes at least three pumps and associated conduits (not shown), each pump being adapted to draw sea water from a respective side of the pipe 8 and expel that water as a jet from the opposite side of the pipe 8, the jets being equally spaced circumferentially about the pipe 8.

By energizing one or more of the control pumps, the operator in the ship 7 may obtain the appropriate jet action to correct the location of the intake orifice 8*a*, should the television display (not shown) in the ship 7 indicate that corrective action must be taken. Details of such control jets need not be discussed for an understanding of the present invention, such techniques being well known from space technology, for example.

A housing 9*e* contains a conventional positive displacement pump (not shown) for creating the underpressure at the intake orifice 8*a* for drawing the nodules from the piles 6 and driving them up to the ship 7. Alternatively, a conventional jet pump as described in the above-mentioned "Ocean Industry" article may be used, or even a jet pump employing compressed air.

One or more conventional electrical cables (not shown) between the ship 7 and the components g*b–e* supplies electrical power and control signals to these components and transmits the video signals to the television display in the ship 7.

Figure 2:
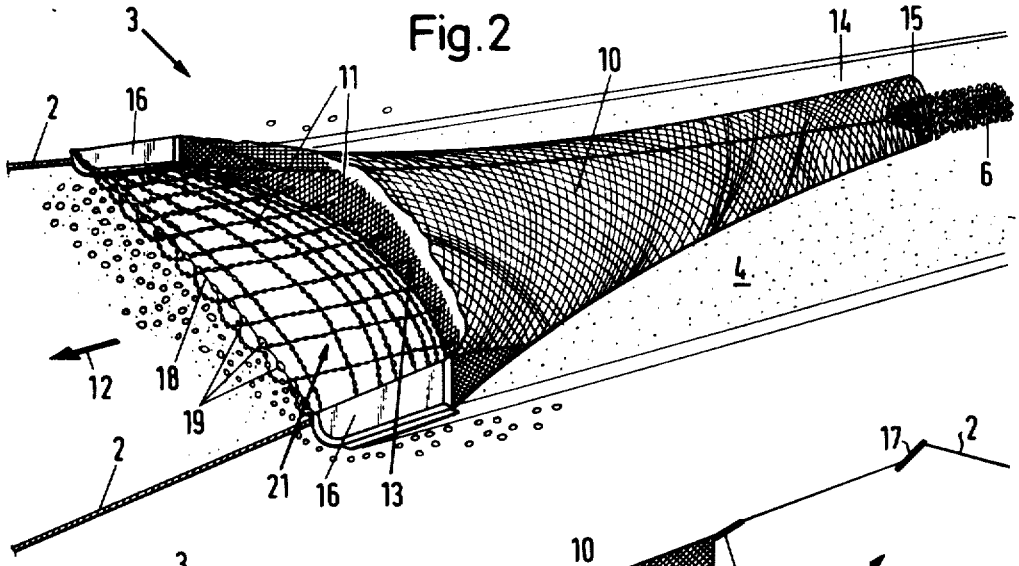
FIG. 2 is a perspective view on a larger scale of the collecting and concentrating apparatus shown in FIG. 1.

As shown in FIG. 2, the collecting and concentrating apparatus 3 includes a hose-like net 10, which assumes a flattened conical shape by its flow resistance, and which scours the ocean floor 4 with its bottom portion 11. Facing the direction of drag indicated by the arrow 12, the net 10 has a wide inlet opening 13 for receiving manganese nodules which subsequently are discharged from the net 10 in concentrated form at its smaller end 14 by way of an exit opening 15, thereby forming strips 6 of piled-up nodules. It should be understood that because the nodules lie scattered on the ocean floor, the direction of drag may be randomly selected. Of course, ocean currents and ocean floor topography might influence the direction of drag which is ultimately selected. Disregarding any such influences, the selection can be made virtually in a random manner.

Figure 3:
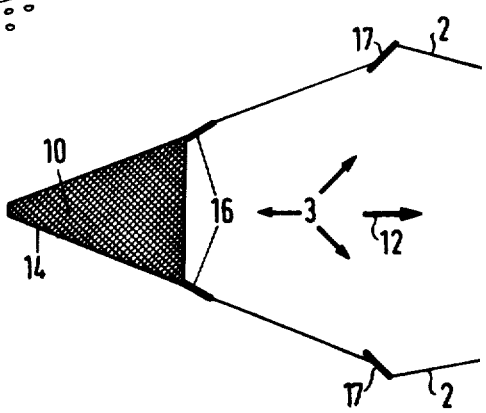
FIG. 3 is a plan view on a smaller scale of the apparatus of FIG. 2, showing also a pair of additional skid plates.

In order to keep the width of the inlet opening 13 as wide as possible, two skid plates 16 are provided before the front end of the net 10 at the sides thereof, disposed substantially vertical relative to the ocean floor 4. The net 10 is connected to the trailing edges of the skid plates, and the cables 2 are connected to the leading edges thereof. The skid plates 16 diverge outwardly in the direction of the arrow 12, so that the flow forces acting on the skid plates spreads open the inlet opening 13. As a result of their position and because they slightly dig into the ocean floor 4, the skid plates 16 also contribute to the concentrating of the manganese nodules. This effect is increased by means of similarly disposed skid plates 17 which, as shown in FIG. 3, are intermediately connected to the cables 2 ahead and laterally of the skid plates 16.

The forward edges of the skid plates 16 are connected to each other by means of a chain 18 formed of buoyant bodies 19, for the purpose of limiting the degree of inclination or divergence of the skid plates, and for the purpose of suspending the leading edge of an "apron" 21. This apron 21, which is made of heavy material and extends across the inlet opening 13, plows open the ocean bottom 4, thereby bringing up and exposing the manganese nodules deposited in the floor, so that also these nodules may be collected by the net 10. The apron 21 may constitute only a portion of the bottom 11 of the net 10, or may form the entire bottom 11.

Figure 4:
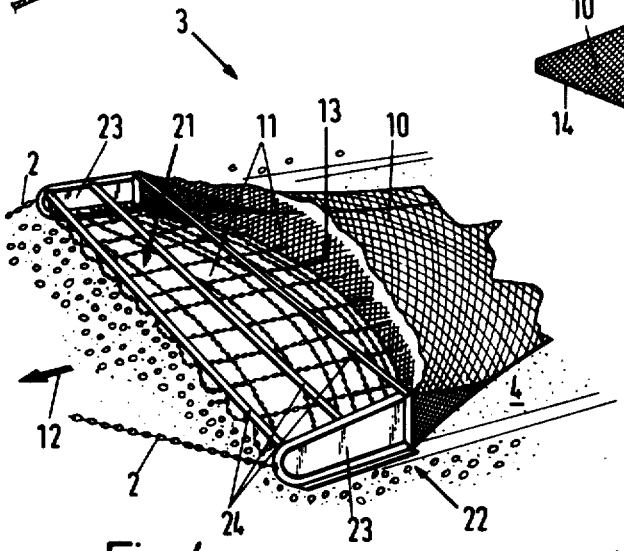
FIG. 4 is a partial perspective view of another embodiment of a collecting apparatus according to the invention.

In the embodiment according to FIG. 4, the inlet opening 13 of the net 10 is determined by the width of a frame 22 having flat and generally U-shaped ends 23, the net 10 being connected to the ends 23. The ends 23 are formed as vertical, diverging skid plates, but they are connected to each other by means of a plurality of rods 24 to form one single rigid unit. One of the rods 24, preferably the most forward one, serves to support the apron 21. The cables 2 are connected to the leading edges of the ends 23.

Figure 5:
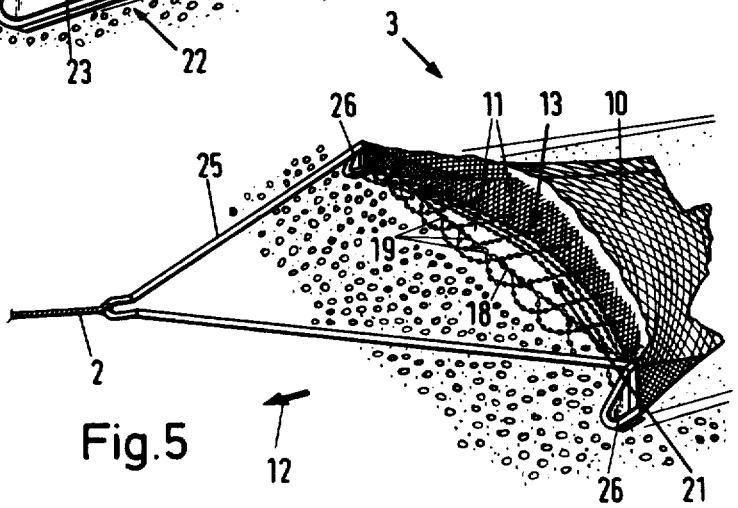
FIG. 5 is a partial perspective view of still another embodiment of a collecting apparatus according to the invention.

In the embodiment according to FIG. 5, the inlet opening 13 is determined by a V-shaped yoke 25, the ends 26 of which are bent around perpendicular to the plane of the yoke so as to form skid plates, to which the net 10 is connected. A chain 18 of buoyant bodies 19 is connected between the ends 26, for suspending the apron 21.

It will be understood that the above described embodiments are merely exemplary and that those skilled in the art may make many variations and modifications without departing from the spirit and scope of the invention. All such modifications and variations are intended to be within the scope of the invention as defined in the appended claims.

We claim:

1. In an apparatus for collecting nodulous mineral deposits on an ocean floor, the apparatus being adapted to be dragged on the ocean floor by at least one cable, the improvement comprising a housing having a front end with a relatively large inlet opening for receiving solids, including nodulous mineral deposits, strewn over the ocean floor and a single rear end, the rear end having a relatively small, unobstructed opening as the only exit at the rear end of the housing for concentrating and discharging substantially all the solids, including the nodulous mineral deposits, received at the front end of the housing, whereby relatively wide strips of the ocean floor are swept when the housing is dragged thereon and substantially all the solids, including the nodulous mineral deposits, in the swept strips are collected and then deposited behind the exit opening in an extended relatively narrow pile.

2. Apparatus according to claim 1, wherein the housing consists of a bag-shaped net which assumes a flattened conical shape when dragged.

3. Apparatus according to claim 2, including rigid frame means extending across the inlet opening of the bag-shaped net, the net being connected to the frame means at the lateral ends thereof and the frame means being adapted to be connected to the cable, each lateral end incuding a skid plate disposed substantially vertically and diverging outwardly before the net when the frame means and the net are dragged on the ocean floor.

4. Apparatus according to claim 3, wherein the rigid frame means includes a rod connected at opposite ends to the two skid plates, and including an array of chains for plowing the ocean floor connected to the rod.

5. Apparatus according to claim 3, wherein the rigid frame means includes a generally V-shaped yoke connected at opposite ends to the two skid plates, the apex of the yoke extending forwardly of the net and being adapted to be connected to the cable, and including a plurality of buoyant bodies connected together extending between the skid plates, and an array of chains for plowing the ocean floor connected to the buoyant bodies.

6. Apparatus according to claim 1 additionally comprising an array of chains at the front end of the housing for plowing the ocean floor, which array includes a plurality of chains disposed substantially perpendicularly of each other to form a mesh the mesh size of the chain array decreasing toward its trailing edge.

7. A method for gathering nodulous mineral deposits disposed on the ocean floor, comprising the steps of dragging a collecting means across a strip of the ocean floor in a randomly selected direction, the collecting means being adapted to receive solids, including nodulous mineral deposits, strewn over the strip of the ocean floor; collecting and concentrating substantially all the solids, including the nodulous mineral deposits, received by the collecting means into an extended pile on the strip of the ocean floor, the width of the extended pile being less than the width of the strip; and thereafter drawing the nodulous mineral deposits from the extended pile and driving them up to the surface of the water.

8. The method of claim 7, wherein the collecting and concentrating step is conducted continuously.

9. Apparatus for collecting solids on the ocean floor and adapted to be dragged on the ocean floor by at least one cable comprising a housing having a relatively large inlet opening at its front end for receiving the solids, a relatively small, unobstructed opening as the only exit at its rear end for discharging the solids thus collected, and an array of chains at the front end of the housing for plowing the ocean floor, which array includes a plurality of chains disposed substantially perpendicularly of each other to form a mesh, the mesh size of the chain array decreasing toward its trailing edge, the housing being adapted to be secured to the cable at its front end, whereby relative wide strips of the ocean floor are swept when the housing is dragged thereon and the solids in the swept strips are deposited behind the exit opening in an extended relatively narrow pile.

* * * * *